US010096897B2

(12) United States Patent
Hojjat et al.

(10) Patent No.: US 10,096,897 B2
(45) Date of Patent: Oct. 9, 2018

(54) GROUND TO AIR ANTENNA ARRAY

(71) Applicant: COMMUNICATION COMPONENTS ANTENNA INC., Kanata (CA)

(72) Inventors: Nasrin Hojjat, Kanata (CA); Minya Gavrilovic, Ottawa (CA); Des Bromley, Ottawa (CA)

(73) Assignee: COMMUNICATION COMPONENTS ANTENNA INC., Kanata (CA)

( * ) Notice: Subject to any disclaimer, the term of this patent is extended or adjusted under 35 U.S.C. 154(b) by 0 days.

(21) Appl. No.: 15/541,144

(22) PCT Filed: Oct. 30, 2015

(86) PCT No.: PCT/CA2015/051116

§ 371 (c)(1),
(2) Date: Jun. 30, 2017

(87) PCT Pub. No.: WO2016/115618

PCT Pub. Date: Jul. 28, 2016

(65) Prior Publication Data

US 2017/0346181 A1 Nov. 30, 2017

Related U.S. Application Data

(60) Provisional application No. 62/107,043, filed on Jan. 23, 2015.

(51) Int. Cl.

| | |
|---|---|
| ***H01Q 3/02*** | (2006.01) |
| ***H01Q 21/06*** | (2006.01) |
| ***H01Q 21/29*** | (2006.01) |
| ***H01Q 25/00*** | (2006.01) |
| ***H01Q 3/00*** | (2006.01) |
| ***H01Q 3/26*** | (2006.01) |

(52) U.S. Cl.

CPC ..... *H01Q 3/02* (2013.01); *H01Q 3/005* (2013.01); *H01Q 3/26* (2013.01); *H01Q 21/065* (2013.01); *H01Q 21/29* (2013.01); *H01Q 25/00* (2013.01)

(58) Field of Classification Search

CPC ..... H01Q 3/02; H01Q 3/005; H01Q 25/00; H01Q 3/26; H01Q 21/065; H01Q 21/29; H01Q 3/04; H01Q 1/246

See application file for complete search history.

(56) References Cited

U.S. PATENT DOCUMENTS

| | | | | |
|---|---|---|---|---|
| 6,735,438 | B1 | 5/2004 | Sabatino | |
| 2008/0246676 | A1 | 10/2008 | Stoyanov | |
| 2010/0099370 | A1 | 4/2010 | Nichols | |
| 2012/0235881 | A1 | 12/2012 | Pan | |
| 2017/0104267 | A1* | 4/2017 | Powell | H01Q 3/04 |

OTHER PUBLICATIONS

ISA/CA, International Search Report and Written Opinion for PCT/CA2015/051116, dated Jan. 25, 2016.

* cited by examiner

*Primary Examiner* — Jessica Han
*Assistant Examiner* — Michael Bouizza
(74) *Attorney, Agent, or Firm* — Brion Raffoul

(57) ABSTRACT

An array antenna with each antenna element in the array being physically tilted away from a base plane of the array. End antenna elements are tilted at a higher angle than regular antenna elements. The radiation pattern, the end antenna elements can provide coverage directly above the antenna array (i.e. at 90 degrees to the horizontal) for different electrical tilts.

13 Claims, 12 Drawing Sheets

GROUND TO AIR ANTENNA ARRAY

TECHNICAL FIELD

The present invention relates to wireless communication. More specifically, the present invention relates to ground-to-air or air-to-ground antennas.

BACKGROUND

Ground-to-air antennas are designed to emit radiation towards the sky, such as towards airplanes. Ground-to-air antennas may also be used to emit radiation from an elevated position towards the ground, such as in stadiums or indoor applications.

Because of the above, the elevation pattern of such antennas must form a specific shape to provide the required radiation coverage at all angles, up to 90 degrees from the horizontal. Ideally, this elevation pattern takes path loss compensation at each tilt of the antenna into consideration. FIG. 1 shows such an example of an ideal elevation pattern for ground-to-air antennas based on path loss. This pattern may not be ideal for all applications.

FIG. 1*a* shows a typical base station pattern with mechanical uptilt. Typical base station antennas create elevation patterns with a null signal directly overhead of the antenna due to the effect of each antenna element's pattern. This is mostly due to the positioning of the array at 90 degrees to the horizon which will give almost zero radiation at 90 degrees above the horizon.

One solution to overcome this issue involves mechanically tilting the antenna unit towards the sky. However, mechanical tilting at certain angles results in problematic configurations for tower-mounted antennas, as shown in FIG. 2. These tower-mounted antennas can be difficult to mount, can be subject to high mechanical stresses, and do not provide the coverage desired.

Another known solution to the null signal produced at 90 degrees (i.e. directly above the antenna) is the use of custom-shaped beam elements in place of an array of antennas. FIG. 3 shows an example of a state of the art ground-to-air antenna elevation pattern from U.S. Pat. No. 6,735,438. However, in such configurations, due to wide beamwidth, gain is low and the angle of the maximum beam cannot be modified easily.

There is therefore a need to mitigate, if not overcome, the shortcomings of the prior art.

SUMMARY

The present invention provides an array antenna with each antenna element in the array being physically tilted away from a base plane of the array. End antenna elements are tilted at an even higher angle than other antenna elements. In such an arrangement, the end antenna elements can provide coverage directly above the antenna array (i.e. at 90 degrees to the horizontal).

In one aspect, the present invention provides an antenna array for ground-to-air communication comprising:

- a plurality of antenna elements, each antenna element being tilted away at a first tilt angle from a base plane of the antenna array;
- at least one end antenna element, the at least one end antenna element being tilted away at a second tilt angle from the base plane of the antenna array;

wherein the second tilt angle is greater than the first tilt angle.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The present invention provides an antenna array in which individual antenna elements can be physically tilted independently to provide enhanced radiation coverage. This antenna array provides coverage 90 degrees above the antenna by means of mechanical tilt for individual elements. The individually tilted antenna elements may have different angles to provide different shaped beams.

In a further aspect, this document discloses an antenna array for ground-to-air communication comprising:

a base plane of the antenna array;

a plurality of base plates operatively mounted on the base plane;

at least one end base plate operatively mounted on an end of the base plane;

a plurality of antenna elements, each of the plurality of antenna elements operatively mounted on one of the plurality of base plates;

at least one end antenna element, each of the at least one end antenna element being mounted on one of the at least one end base plate;

wherein at least one of said plurality of base plates being tilted away at a first tilt angle from the base plane of the antenna array;

wherein the at least one end base plate being tilted away at a second tilt angle from the base plane of the antenna array; wherein the second tilt angle is greater than the first tilt angle.

In one aspect of the present invention, the effective tilt of the full antenna array may be changed by introducing phase-shifters. These phase-shifters can adjust the effective tilt of the resulting beam. However each physical antenna element can be physically (i.e. mechanically) tilted relative to a base plane of the antenna array in order to provide radiation at angles which may not otherwise be reachable by signals from the array.

In one implementation, by using an electrical beam tilt, the resulting beam tilt of an individual antenna element may be up to 20 degrees without requiring more than 8 degrees of mechanical uptilt.

FIGS. 4, 5, 6 and 7 show various embodiments of the present invention.

Figure 1:
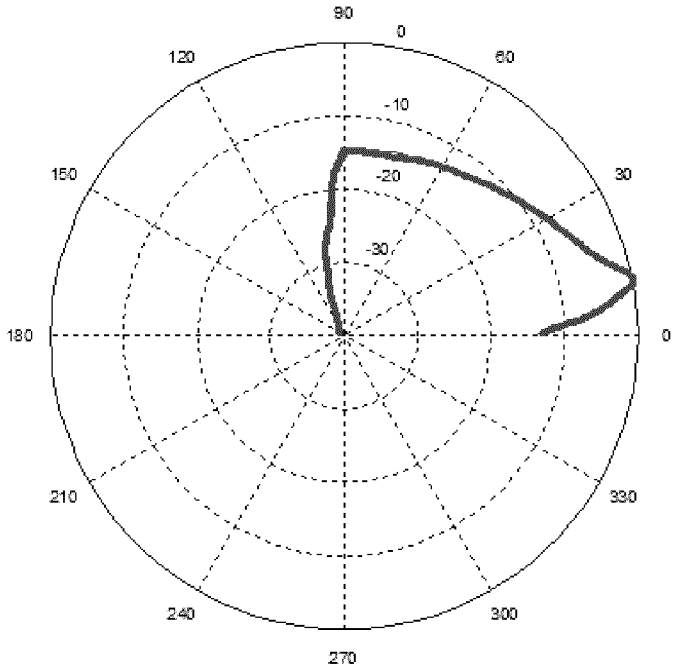
FIG. 1 shows an example of an ground-to-air antenna elevation pattern based on path loss compensation.
Figure 1A:
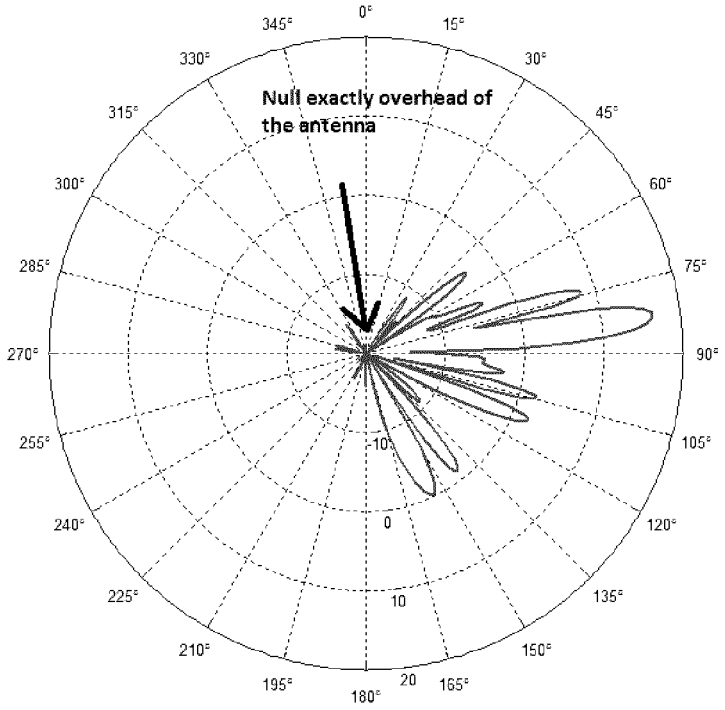
FIG. 1A shows a typical uptilted base station pattern with null at 90 degrees above horizon.
Figure 2:
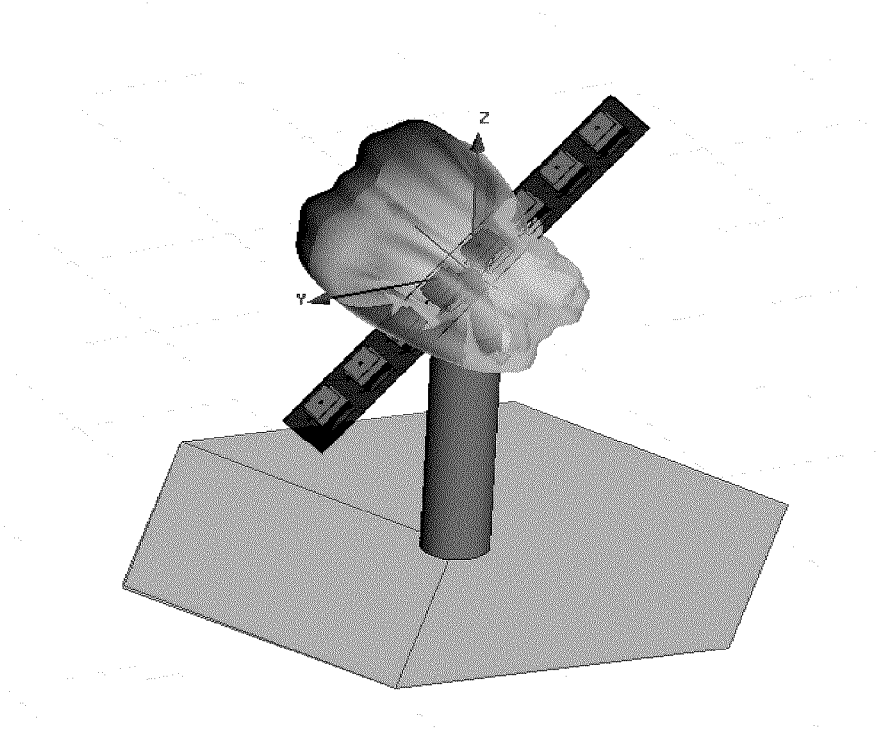
FIG. 2 shows a mechanically tilted antenna array known in the prior art.
Figure 3:
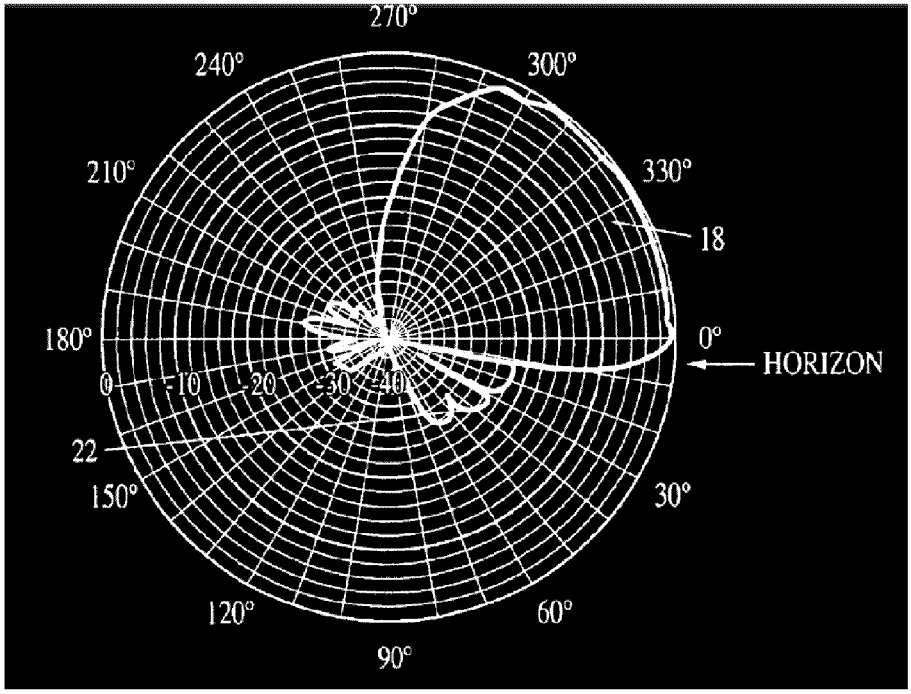
FIG. 3 shows an air-to-ground pattern known in the prior art.
Figure 4:
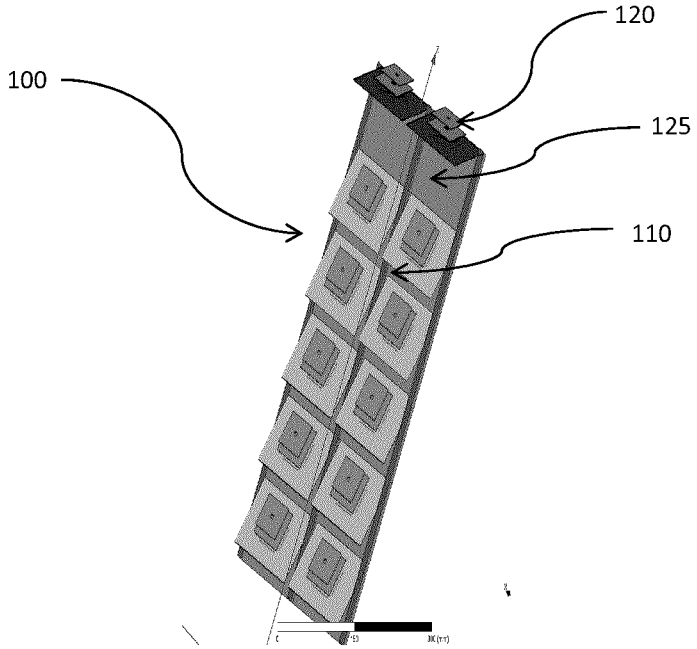
FIG. 4 shows a perspective view of one embodiment of the present invention.

Referring to FIG. 4, one aspect of the present invention is illustrated. An antenna array 100 in isometric view includes several individual antenna elements 110. Top or end individual antenna elements 120 are positioned at one end of the antenna array 100. In this embodiment, the antenna array is a 5×2 array, not including the end antenna elements. For ease of reference, it should be noted that the antenna array 100 has a flat base plane 125 that functions as the base for the multiple antenna elements 110. Each individual antenna element 110 includes a base plate on which a patch antenna is placed along with suitable associated circuitry. It should be clear from the Figure that all the antenna elements, including the end antenna elements, are tilted or angled away from the base plane in such a way that provide the desired pattern. The elements, therefore, can each be tilted in different directions and have different tilt angles with respect to the base plane.

As can be seen from FIG. 4, each individual antenna element 110 is angled away from the base plane of the antenna array 100. The end antenna elements 120 are also angled away from the base plane of the antenna array 100 but the angle between the base plates of the end antenna elements 120 and the base plane is higher than the angle between the base plates of the regular antenna elements 110 and the base plane. In one embodiment, the individual antenna elements 110 are angled at between 25-30 degrees from the base plane 125 while the end antenna elements 120 are angled at between 50-70 degrees from the base plane 125. The difference in angle or tilt between the regular antenna elements and the end antenna elements allow for coverage of the area directly above the antenna array by way of the end antenna elements.

Figure 5:
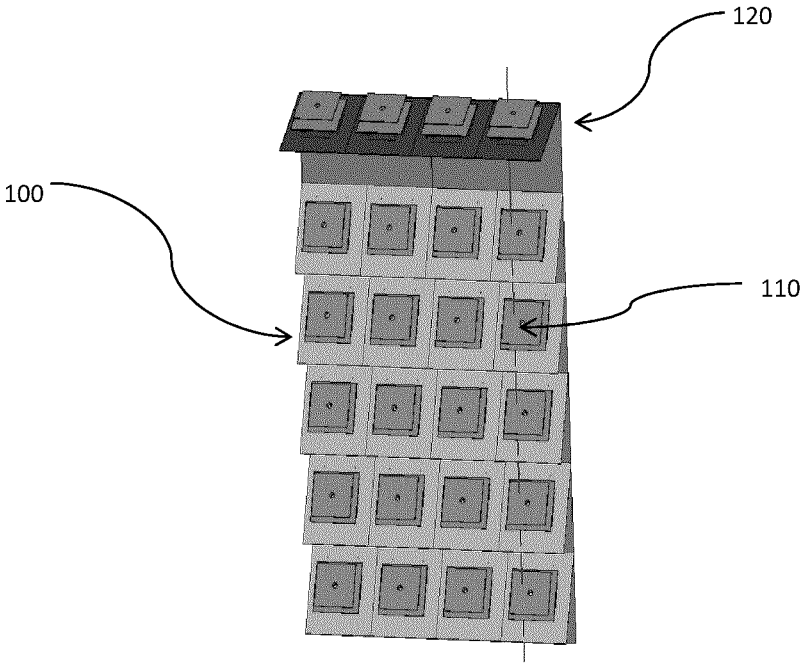
FIG. 5 shows a front view of another embodiment of the present invention.

Referring to FIG. 5, another embodiment of the present invention with two side by side antennas, each having a 45 degree azimuth pattern is illustrated. In this embodiment, the antenna array is a 5×4 array with 5 rows and 4 columns of antenna elements 110, not counting the end antenna elements 120. This can provide different azimuth beamwidth patterns while shaping the pattern through the elevation. Multiple configurations, with different numbers of rows and/or columns from those illustrated are, of course, possible.

It should be noted that, for better coverage, the resulting beam the antenna array can be electronically tilted to increase or decrease the effect of the mechanical tilting or angling of the physical antenna elements. As such, if the antenna array is deployed such that the base plane of the array is perpendicular to the horizontal, coverage of the area directly above the antenna array may be obtained by the tilted elements, particularly the end element. The general shape of the pattern and its beam peak can be modified by electronically steering the beam.

Figure 6:
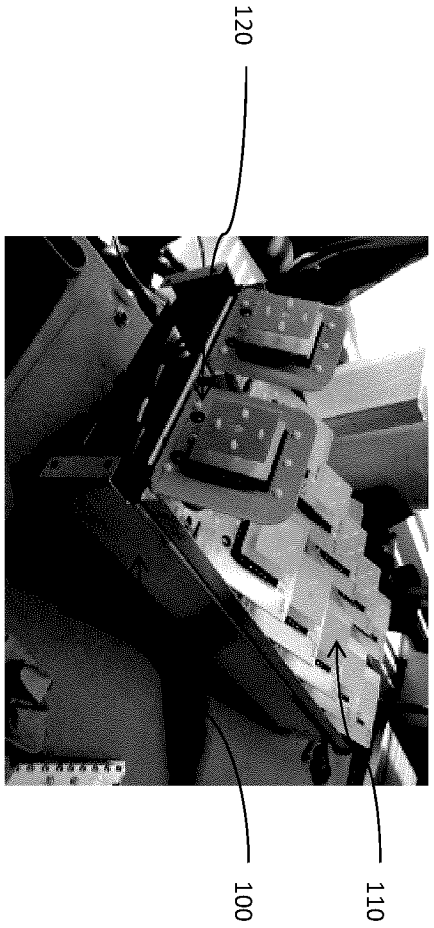
FIG. 6 shows another embodiment of the present invention with individual elements tilted at 25 degrees and the end element tilted at 65 degrees with a 65 degree azimuth pattern.

FIG. 6 shows another embodiment of the present invention. In this embodiment, the antenna array 100 includes two end individual antenna elements 120 and two rows and two columns of individual antenna elements 110. In this embodiment, the individual antenna elements 110 are mechanically tilted upward by 25 to 30 degrees and the top individual antenna elements 120 are mechanically tilted at a higher angle, between 50 and 70 degrees.

Figure 7:
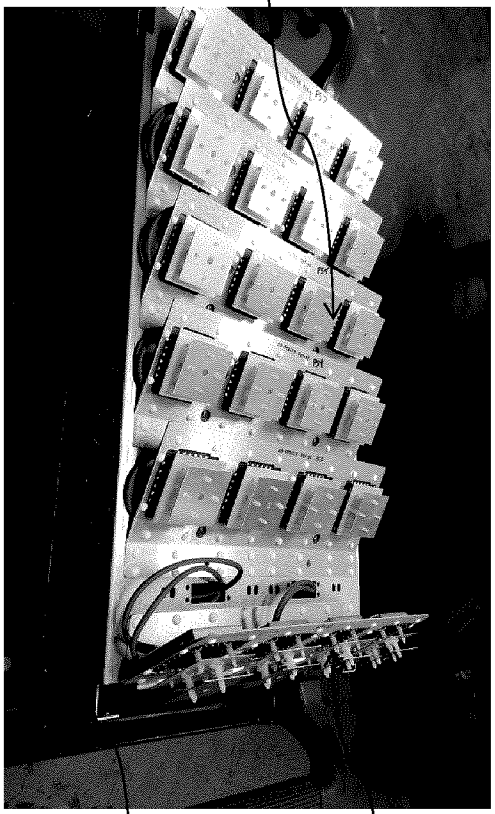
FIG. 7 shows another embodiment of the present invention with individual elements tilted at 25 degrees and the end element tilted at 65 degrees with a 2 elements designed 45 degree azimuth pattern.

FIG. 7 shows another embodiment of the present invention. In this embodiment, the antenna array 100 includes four end individual antenna elements 120 and four columns and five rows of individual antenna elements 110. It should be noted that while the individual antenna elements are uniformly spaced with respect to the other antenna elements in the figures, other embodiments with non-uniform spacing between antenna elements are also possible.

Figure 8:
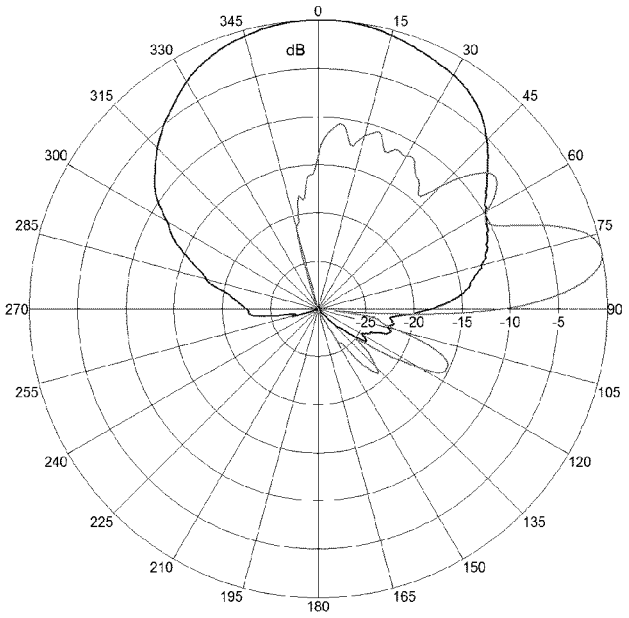
FIG. 8 shows the novel ground-to-air antenna elevation and azimuth pattern measurements with individual elements tilted at 25 degrees and the end element tilted at 65 degrees with a 65 degree azimuth pattern.

FIG. 8 shows an azimuth and elevation coverage plot for an embodiment of the present invention where the antenna array includes 6 individual antenna elements connected to a 6 output phase shifter (embodiment not shown in Figures). In this embodiment of the present invention, the individual antenna elements use dual-polarity patch antennas. Furthermore, the end individual antenna element is mechanically tilted at 65 degrees and the regular individual antenna elements are mechanically tilted at 25 degrees. Fences were used to shape the beam in azimuth. As noted above, the individual antenna elements can be remotely controlled to provide electrical tilting of the resulting beam. For this embodiment, the remote controlled electrical uptilt was between 5 and 20 degrees. Another embodiment of the present invention may provide adjacent dual-polarity antennas, thereby effectively providing a 4-port antenna (as shown in FIG. 6).

Figure 9:
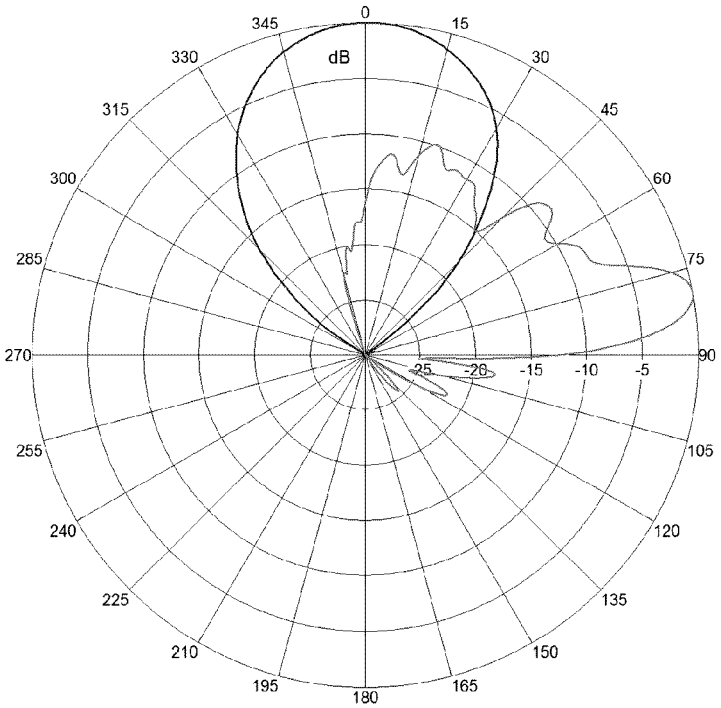
FIG. 9 shows the novel ground-to-air antenna elevation and azimuth pattern measurements with individual elements tilted at 25 degrees and the end element tilted at 65 degrees with a 2 elements designed 45 degrees azimuth pattern.

FIG. 9 shows an azimuth and elevation coverage plot for an implementation of the present invention with individual antenna elements angled at 25 degrees from the base plane while the end antenna elements 120 are angled at 65 degrees from the base plane 125. In the embodiment of the present invention used to obtain this plot, an azimuth splitter was used between two individual antenna elements to provide azimuth 45 degree beamwidth.

Figure 10:
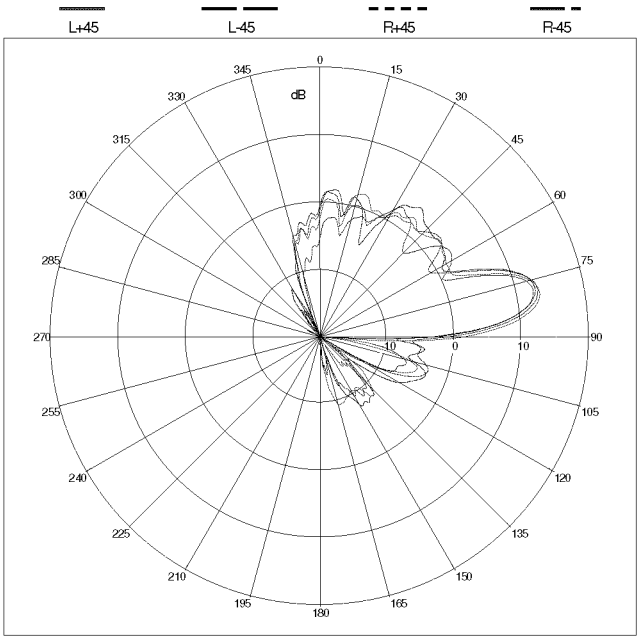
FIG. 10 shows the novel ground-to-air antenna elevation pattern measurements with electrical tilt of 13 degrees provided by a phase shifter at 2317 MHz, where the elements are 25 degrees tilted and the end element is tilted from 65 degrees the base plane.

FIG. 10 shows an elevation coverage plot for an implementation of the present invention with individual antenna elements angled at 25 degrees from the base plane and the end element angled at 65 degrees, while phase of the elements adjusted by a phase shifter to provide 13 degrees uptilt for the array.

Figure 11:
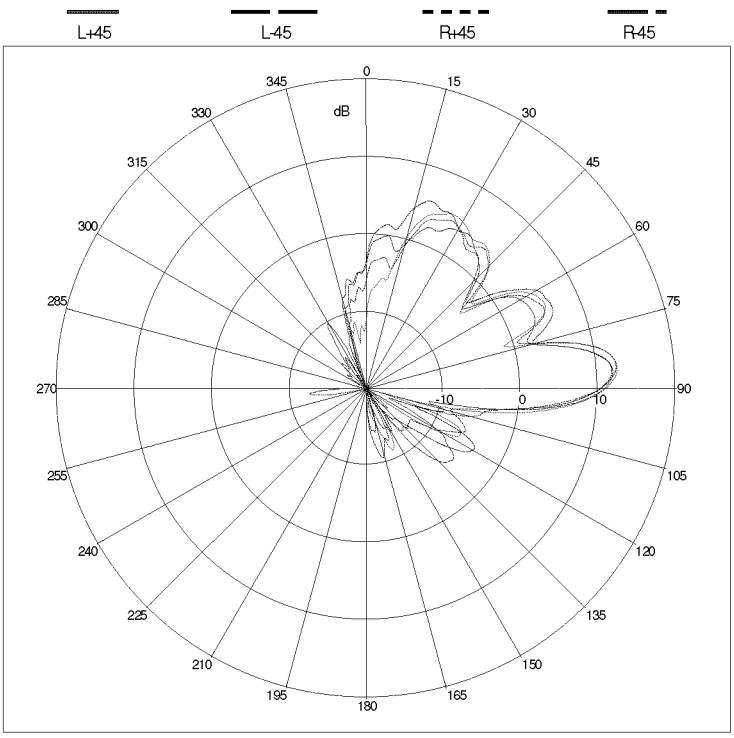
FIG. 11 shows the novel ground-to-air elevation pattern measurements with electrical tilt of 5 degrees provided by a phase shifter at 2317 MHz, where the elements are 25 degrees tilted and the end element is tilted 65 degrees from the base plane.

FIG. 11 shows an elevation coverage plot for an implementation of the present invention with individual antenna elements angled at 25 degrees from the base plane and the end element is angled at 65 degrees, while the phase of the elements is adjusted by a phase shifter to provide a 5 degrees uptilt for the array.

The present invention can also be used to reduce the sidelobe near the ground by combining mechanical and electrical beam tilting. For example, sidelobes can be reduced by mechanically uptilting antenna by 5 degrees and compensating with an electrical downtilt of −5 degrees. This provides lower elevation sidelobe level (SLL) toward the ground.

Another embodiment of the present invention uses a metal antenna end-cap to reduce SLL towards the ground. Such a configuration can be used to reduce the SLL underneath the antenna array.

It should be noted that the present invention may be used for multibeam or dual-band or multi-band antennas.

The present invention can be used for air-to-ground communications. For example, in one embodiment of the present invention, individual antenna elements may be mechanically or electrically downtilted to direct precisely shaped beams towards the ground.

A person understanding this invention may now conceive of alternative structures and embodiments or variations of the above all of which are intended to fall within the scope of the invention as defined in the claims that follow.

What is claimed is:

1. An antenna array for ground-to-air communication comprising:

a base plane of the antenna array;

a plurality of base plates operatively mounted on the base plane;

at least one end base plate operatively mounted on an end of the base plane;

a plurality of antenna elements, each of the plurality of antenna elements operatively mounted on one of the plurality of base plates;

at least one end antenna element, each of the at least one end antenna element being mounted on one of the at least one end base plate;

wherein at least one of said plurality of base plates being tilted away at a first tilt angle from the base plane of the antenna array;

wherein the at least one end base plate being tilted away at a second tilt angle from the base plane of the antenna array;

wherein the second tilt angle is greater than the first tilt angle.

2. The antenna array according to claim 1, wherein the first tilt angle of any of said plurality of base plates is between 25 to 30 degrees.

3. The antenna array according to claim 1, wherein the second tilt angle of any of said at least one end base plate is between 50 to 70 degrees.

4. The antenna array according to claim 1, wherein resulting beams from the plurality of antenna elements are electrically beam tilted by a phase-shifter.

5. The antenna array according to claim 1, wherein resulting beams from the antenna array are electrically beam tilted by a phase-shifter.

6. The antenna array according to claim 1, wherein at least one antenna element of the plurality of antenna elements comprises a dual-polarity patch antenna.

7. The antenna array according to claim 1, wherein the at least one end antenna element comprises a dual-polarity patch antenna.

8. The antenna array according to claim 1, wherein resulting beams are beam tilted by remote control.

9. The antenna array according to claim 1, wherein the antenna array is multi-beam antenna.

10. The antenna array according to claim 1, wherein the antenna array is a dual-band antenna.

11. The antenna array of claim 1, in which an angle of each of the plurality of antenna elements from the base plane and spacing in elevation is optimized to provide an elevation pattern for a specific application.

12. The antenna array of claim 1, wherein at least one of said plurality of base plates being tilted away at a third tilt angle from the base plane of the antenna array.

13. The antenna array of claim 1, wherein another end base plate of the at least one end base plate is being tilted away at a fourth tilt angle from the base plane of the antenna array.

* * * * *